US005645225A

United States Patent [19]

Hasegawa et al.

[11] Patent Number: 5,645,225

[45] Date of Patent: Jul. 8, 1997

[54] VARIABLE INJECTION HOLE TYPE FUEL INJECTION NOZZLE

[75] Inventors: Toshiyuki Hasegawa; Shinya Nozaki; Takeshi Miyamoto, all of Higashi-Matsuyama, Japan

[73] Assignee: Zexel Corporation, Tokyo, Japan

[21] Appl. No.: 557,572

[22] Filed: Nov. 14, 1995

[30] Foreign Application Priority Data

Nov. 15, 1994 [JP] Japan ..... 6-304236
Apr. 11, 1995 [JP] Japan ..... 7-109189

[51] Int. Cl.[6] ..... F02M 61/18

[52] U.S. Cl. ..... 239/533.12; 239/581.1

[58] Field of Search ..... 239/533.12, 562–564, 239/581.1; 251/304, 309

[56] References Cited

U.S. PATENT DOCUMENTS

| | | | |
|---|---|---|---|
| 1,833,080 | 11/1931 | Kenworthy | 239/563 |
| 2,003,814 | 6/1935 | Taylor | 239/563 X |
| 2,288,012 | 6/1942 | Mongan | 239/562 X |

FOREIGN PATENT DOCUMENTS

| | | | |
|---|---|---|---|
| 2450358 | 9/1980 | France . | |
| 100228 | 1/1926 | Germany | 239/562 |
| 703194 | 1/1941 | Germany | 239/533.12 |
| 2948451 | 6/1981 | Germany . | |
| 3623364 | 1/1988 | Germany . | |
| 59-200063 | 11/1984 | Japan . | |
| 4-76266 | 3/1992 | Japan . | |
| 272470 | 9/1992 | Japan | 239/533.12 |

OTHER PUBLICATIONS

Patent Abstracts of Japan, vol. 10, No. 130 (M–478), 14 May 1986 & JP–A–60 256555, Dec. 1985.

Patent Abstracts of Japan, vol. 8, No. 201, (M–325), 14 Sep. 1984 & JP–A–59 090765, May 1984.

Patent Abstracts of Japan, vol. 11, No. 155 (M–589), 10 May 1987 & JP–A–61 286577, Dec. 1986.

*Primary Examiner*—Kevin Weldon

*Attorney, Agent, or Firm*—Pearne, Gordon, McCoy & Granger LLP

[57] ABSTRACT

A plurality of injection holes are circumferentially arranged in the peripheral wall of the hole at predetermined intervals and at axially different circumferential levels in the leading end portion of the nozzle body to introduce pressurized fuel, and the injection holes at each circumferential level are set different in diameter. On the other hand, a rotary valve has a plurality of fuel guide holes each corresponding to the injection holes at the respective circumferential levels. The fuel guide holes of the rotary valve and the injection holes of the nozzle body are arranged in such a relationship that while the fuel guide holes at one or more than one circumferential level are each made to communicate with the fuel guide holes at one or more than one corresponding circumferential level, the fuel guide holes at the other circumferential levels are not allowed to communicate with any injection holes.

6 Claims, 13 Drawing Sheets

VARIABLE INJECTION HOLE TYPE FUEL INJECTION NOZZLE

BACKGROUND OF THE INVENTION

1. Field of the Invention

The present invention relates to a fuel injection nozzle and more particularly to a variable injection hole type fuel injection nozzle.

2. Description of the Related Art

Extreme importance has been directed to NOx reduction in a low-speed, low-load region and to smoke reduction in the high-load region of high-pressure injection systems, though the high-pressure injection systems have been known effective in dealing with gas waste from diesel engines. In order to cope with the former problem, it is preferred to reduce the initial injection rate by effecting fuel injection for a long period of time using small-diameter injection holes and to establish optimum burning condition by accelerating fuel atomization, whereas in order to solve the latter problem, it is preferred to effect fuel injection for a short period of time using large-diameter injection holes.

However, a conventional fuel injection nozzle of the sort disclosed in Japanese Patent Unexamined Publication No. Sho 59-200063 has been only structured so that fuel is injected from an injection hole formed at the leading end of a nozzle body by forming a tapered pressure receiving face on the leading end side of a needle valve slidably accommodated in the nozzle body and letting the valve open because of fuel injection pressure. As a result, the injection hole diameter, that is, the injection hole area becomes fixed, which makes it impossible to deal with problems including expediting fuel burning, improving output•fuel cost, reducing not only noise resulting from fuel burning but also Nox and the like.

In order to tackle on the aforementioned problems, there has been proposed a variable injection nozzle designed for the injection hole area to be made variable and for the injection hole to be made switchable as desired by means of an actuator. An injection nozzle of such a type that has been proposed in Japanese Patent Unxamined Publication No. Hei 4-76266 has a plurality of injection holes circumferentially provided at predetermined intervals in the leading end portion of a nozzle body, the injection holes communicating with an internal hole to which a rotary valve is rotatably fitted, so that the opening of the injection hole is rendered adjustable as the rotary valve rotates.

The rotary valve type fuel injection nozzle like this is not designed to control injection holes at their axial positions as in a translation type fuel injection nozzle, that is, a fuel injection of such a type so as to move its valve shaft in the direction of an axial line. Thus, it is unnecessary to hold the position of injection holes against the axial force generated in the valve shaft due to the injection pressure and the pressure in the engine cylinder. Consequently, a desired injection hole area can be set by extremely small control torque if only the rotation of the rotary valve is controlled during the intake or exhaust stroke, whereby a very small actuator becomes usable with the merit of restraining the nozzle from becoming greater in size.

A specific injection nozzle according to the prior art, for example, includes a plurality (eight) of injection holes arranged in a circumferential hole wall, a rotary shaft provided as a rotary valve in the hole, and a plurality (four) of guide grooves circumferentially formed at predetermined intervals at the outer peripheral leading end of the rotary shaft, whereby the four and eight injection holes are selectively used for fuel injection as the rotary position of the rotary shaft varies.

Therefore, no injection hole variation using multiple injection holes can be set since the plurality of injection holes are situated only at one circumferential level. More specifically, it is impossible to control fuel injection by varying the injection hole diameter to deal with the waste gas as noted previously since the injection hole diameter itself remains invariable except that the number of injection holes having the same diameter on the same circumferential level can simply be increased or decreased according to the prior art. The problem is that atomization during the time a low load is applied is difficult to achieve.

In view of the fact that the diameter of the driving shaft of the rotary valve is small as the driving shaft is passed through the needle valve, moreover, the driving shaft is difficult to seal up. Therefore, fuel is caused to leak out of the driving shaft, which may result in lowering injection pressure or deficiency in fuel at the time of fuel injection.

In the case of a variable injection nozzle generally so constructed that injection holes are totally and temporarily closed when one injection hole diameter is switched to another, pressure in the nozzle body will sharply rise if one injection hole is switched to another during the time fuel injection is carried out. In case the needle valve ceases to operate for some reason or other or in case the follow-up opening of the rotary valve is delayed at the time the engine is operated at high speed, the pressure in the nozzle body will increase to the extent of danger in that the fuel injection system such as the fuel injection nozzles, the fuel injection pump or piping for connecting them is destroyed.

SUMMARY OF THE INVENTION

The present invention has been made to solve the foregoing problems, and therefore one object of the present invention is to provide a variable injection hole type fuel injection nozzle capable of offering greater freedom of setting injection holes and altering the whole area occupied by the injection holes, obviating any abnormal rise in the internal pressure of a nozzle body even when injection holes for use are selected during fuel injection, freely injecting fuel in such a manner as to make injection pressure, injection time and injection quantity correspond to the load and the number of revolutions of an engine, and effectively attaining reduction in Nox and the promotion of atomization in a low-speed, light-load region and reduction in smoke in a high-load region.

Another object of the present invention is to provide a variable injection hole type fuel injection nozzle also capable of preventing after-dripping in addition to the capability mentioned in the first object thereof.

Still another object of the present invention is to provide a variable injection hole type fuel injection nozzle capable of preventing a drop in injection pressure and a shortage of injection quantity when injection holes are selected by rotating a rotary valve.

In order to accomplish the one object of the invention, a variable injection hole type fuel injection nozzle having a rotary valve in the leading end portion of a nozzle body, wherein a hole for introducing pressurized fuel is formed in the leading end portion of the nozzle; a plurality of injection holes are circumferentially arranged in the peripheral wall of the hole at predetermined intervals and at axially different circumferential levels; and the injection holes at each circumferential level are set different in diameter; wherein a rotary valve having a plurality of fuel guide holes each corresponding to the injection holes at the respective circumferential levels is provided in the hole; and wherein the fuel guide holes of the rotary valve and the injection holes of the nozzle body are arranged in such a relationship that irrespective of the rotary position of the rotary valve, the fuel guide holes at one or more than one circumferential level are each made to communicate with the fuel guide holes at one or more than one corresponding circumferential level and that the fuel guide holes at the other circumferential levels are not allowed to communicate with any injection holes.

In this case, the hole may be a closed-end hole or what has an open front end.

In order to accomplish the another object of the invention, a variable injection hole type fuel injection nozzle having a rotary valve in the leading end portion of a nozzle body, wherein a closed-end hole for introducing pressurized fuel is formed in the leading end portion of the nozzle; a plurality of injection holes are circumferentially arranged in the peripheral wall of the hole at predetermined intervals and at axially different circumferential levels; and the injection holes at each circumferential level are set different in diameter; wherein a rotary valve having a plurality of fuel guide holes each corresponding to the injection holes at the respective circumferential levels is provided in the hole; wherein the fuel guide holes of the rotary valve and the injection holes of the nozzle body are arranged in such a relationship that irrespective of the rotary position of the rotary valve, the fuel guide holes at one or more than one circumferential level are each made to communicate with the fuel guide holes at one or more than one corresponding circumferential level and that the fuel guide holes at the other circumferential levels are not allowed to communicate with any injection holes; and wherein a return spring for pressing the rotary valve toward the base of the hole is provided in the upper portion of the rotary valve; and the fuel guide holes are each allowed to the corresponding injection holes only when the rotary valve is lifted on receiving fuel pressure from the hole.

In order to accomplish the still another object of the invention, a rotary-valve driving system has an area seal movable in a needle valve integrally with the needle valve.

According to the present invention, the rotary valve is preferably actuated by an actuator in synchronization with the intake or exhaust stroke given by an engine.

According to the present invention, the plurality of injection holes having the same diameter at the same circumferential level are axially arranged at a plurality of stages but the injection holes at different stages differ in diameter. The rotary valve within the hole has the plurality of fuel guide holes corresponding in number and interval to the injection holes at the corresponding stages, and the fuel guide holes and the injection holes each adapted for communicating with the former at the respective stages are out of phase with one another. If, therefore, the rotation of the rotary valve is controlled with the actuator during the intake and/or exhaust stroke given by an engine, the fuel guide holes and the injection holes at least one stage are so related that they communicate with one another at that angle of rotation and that the injection holes at the other stages are closed. Since the plurality of injection holes are circumferentially and relatively different in diameter as long as the stages to which they belong are concerned, free fuel injection can be made possible by using large-, intermediate- or small-diameter injection holes. Proper fuel injecting condition which is full of variety and conforms to the number of revolutions and the load of the engine can thus be created.

Since the fuel guide holes and the injection holes at least at one stage communicate with one another, irrespective of the rotary position of the rotary valve, the inside pressure of the rotary valve is prevented from sharply rising even though the injection holes are changed during the injecting operation as the pressure is allowed to escape.

When the rotary valve is set rotatable and vertically movable within the hole, and can be pressed by the return spring above in the direction of the base of the hole, the fuel guide holes and the injection holes at all stages are stopped from communicating with one another during a non-injecting operation, so that fuel at the time of fuel injection is injected because of the fuel pressure from the fuel guide holes and the injection holes circumferentially conforming to one another only when the rotary valve is lifted. When the fuel injection is subsequently terminated, the rotary valve is lowered and seated on the base of the hole, whereby the fuel guide holes and the injection holes at all stages are stopped from communicating with one another to ensure that the fuel flow is readily broken off and that after-dripping is prevented.

As the driving system of the rotary valve has the area seal integrally movable with the needle valve within the needle valve, the driving force in the direction of rotation is applicable to the rotary valve, and the pressurized fuel in the region of the rotary valve is shut off by the area seal. Therefore, the fuel is prevented from leaking out of the periphery of the driving shaft in the rear of that region to ensure that the pressurized fuel is injected.

The nature, utility and principle of the invention will be more clearly understood from the following detailed description and the appended claims when read in conjunction with the accompanying drawings.

BRIEF DESCRIPTION OF THE DRAWINGS

FIGS. 7A to 7C are diagrams showing the injection hole at each stage at an angle of rotation in the second aspect above, in which FIG. 7A is an enlarged transverse sectional view showing the relation between the upper injection hole and the upper fuel guide hole; FIG. 7B is an enlarged transverse sectional view showing the relation between the intermediate injection hole and the intermediate fuel guide hole; and FIG. 7C is an enlarged transverse sectional view showing the relation between the lower injection hole and the lower fuel guide hole;

FIGS. 8A to 8C are diagrams showing the state of the injection hole at each stage when the angle of rotation is changed counterclockwise by the predetermined angle (20°) from what is shown in FIG. 7, in which FIG. 8A is an enlarged transverse sectional view showing the relation between the upper injection hole and the upper fuel guide hole; FIG. 8B is an enlarged transverse sectional view showing the relation between the intermediate injection hole and the intermediate fuel guide hole; and FIG. 8C is an enlarged transverse sectional view showing the relation between the lower injection hole and the lower fuel guide hole;

FIGS. 9A to 9E are diagrams showing the state of the injection hole at each stage when the angle of rotation is changed counterclockwise by the predetermined angle (20°) from what is shown in FIG. 8, in which FIG. 9A is an enlarged transverse sectional view showing the relation between the upper injection hole and the upper fuel guide hole; FIG. 9B is an enlarged transverse sectional view showing the relation between the intermediate injection hole and the intermediate fuel guide hole; and FIG. 9C is an enlarged transverse sectional view showing the relation between the lower injection hole and the lower fuel guide hole;

DETAILED DESCRIPTION OF THE PREFERRED EMBODIMENTS

A description will subsequently be given of embodiments of the present invention with reference to the attached drawings.

FIGS. 1 to 9 inclusive, refer to a first embodiment of the present invention, and FIGS. 1 to 5B show a first aspect thereof.

Figure 1:
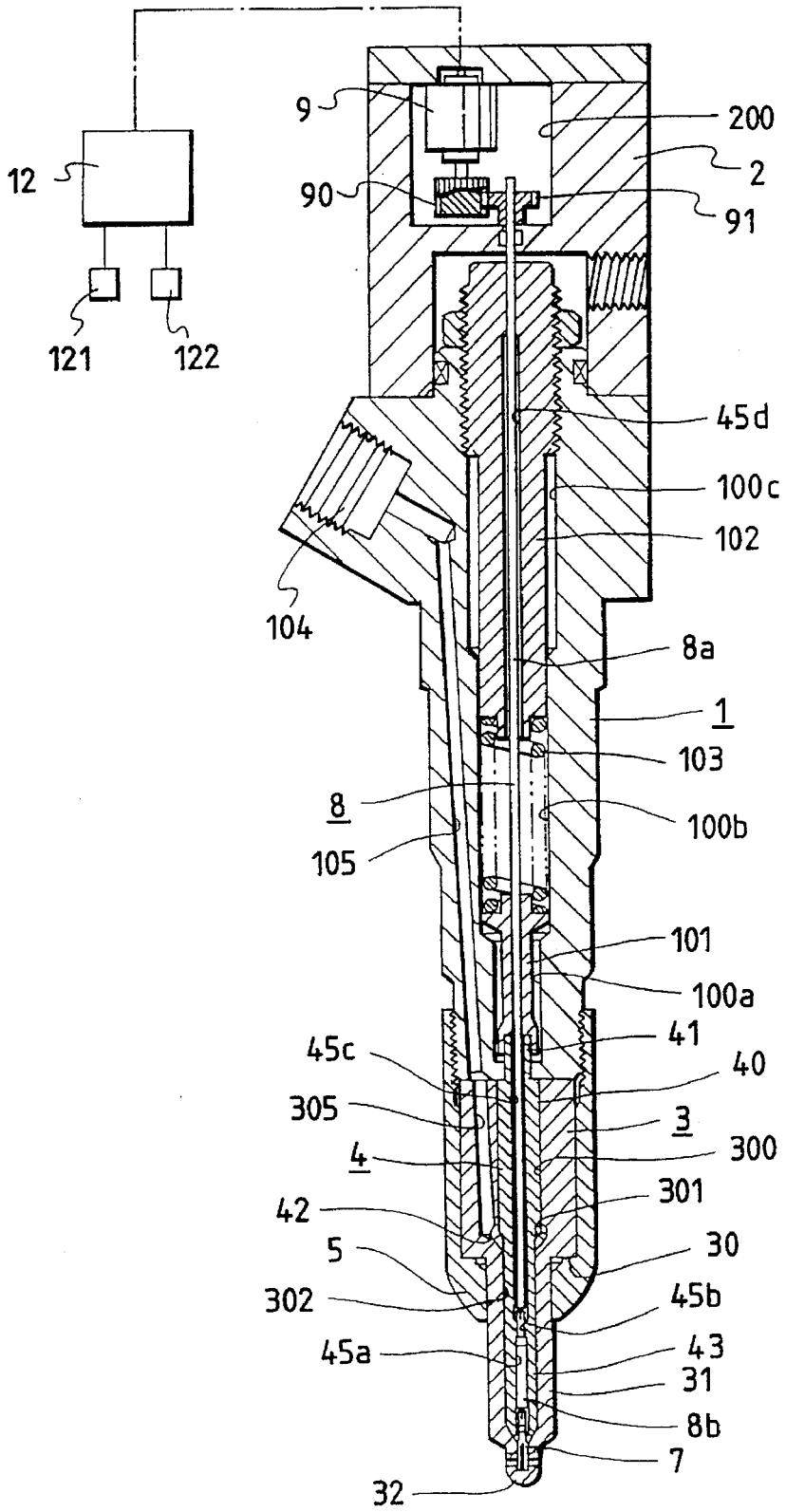
FIG. 1 is a vertical sectional view showing a variable injection hole type fuel injection nozzle according to a first embodiment of the present invention.

In FIG. 1, reference numeral 1 designates a nozzle holder body; 2, a driving head securely and oil-tightly fitted via an O-ring to the upper end portion of the nozzle holder body 1; 3, a nozzle body coupled by a retaining nut 5 to the nozzle holder body 1; and 4, a needle valve (nozzle needle) internally fitted to the nozzle body 3.

A first to a third hole 100*a*, 100*b* and 100*c* are bored through the shaft center of the nozzle holder body 1, the diameters of these holes being gradually enlarged from the lower end up to the upper end of the nozzle holder body 1. Moreover, a push rod 101 is slidably fitted in an area between the first and second holes 100*a* and 100*b*.

Further, an adjusting screw 102 which is screwed into the internal thread of the third hole 100*c* is fitted in an area between the third and second holes 100*c*, 100*b*, and a nozzle spring 103 is held between the adjusting screw 102 and the push rod 101.

The nozzle body 3 has a stepped part 30 mating with the box hole base of a retaining nut 5 in the longitudinal mid-portion of the outer face of the nozzle body 3, which also has a main portion 31 extending through the retaining nut 5 under the stepped part 30. In addition, a small-diameter injection hole part 32 is formed via a tapered part at the leading end of the main portion 31.

Figure 2:
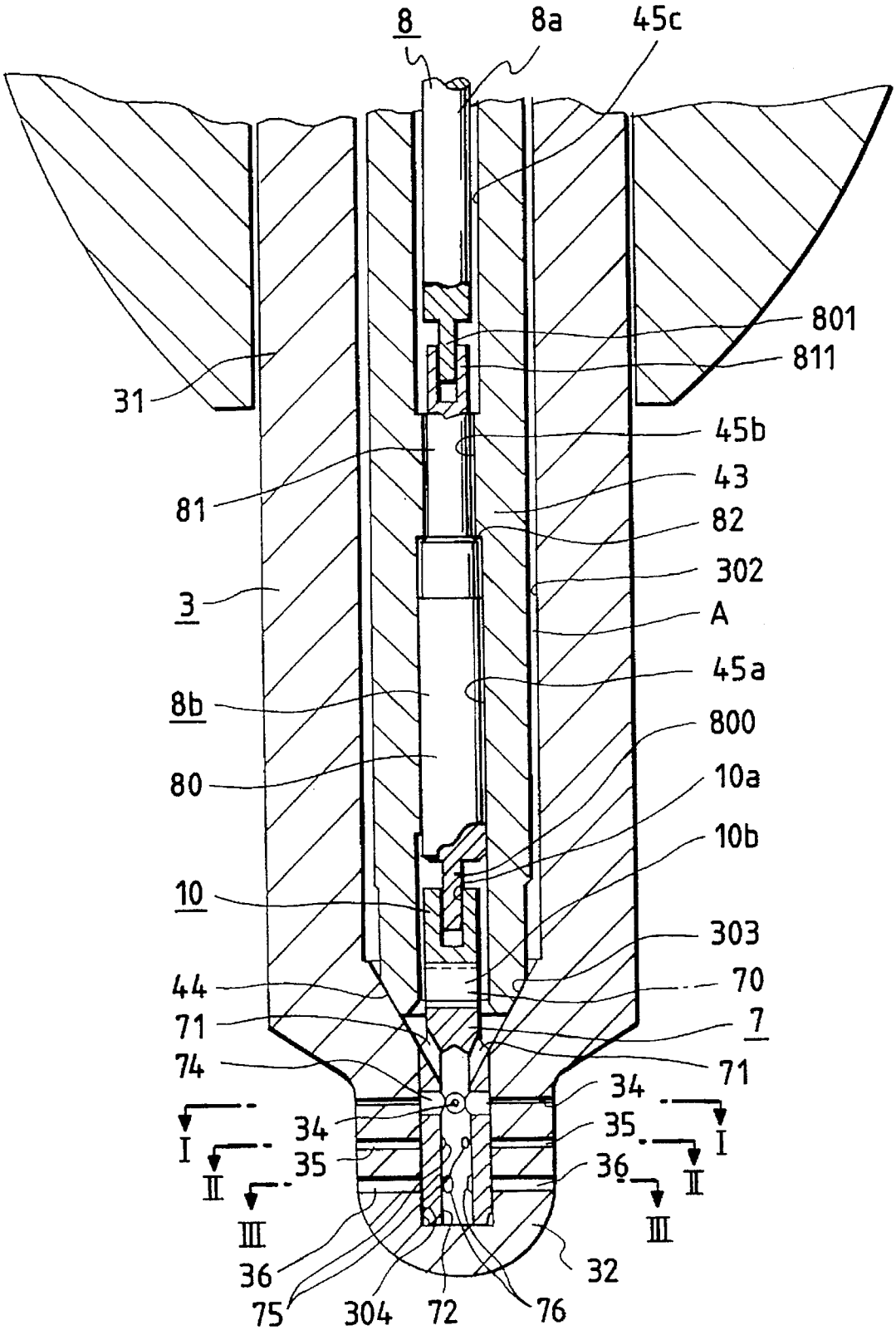
FIG. 2 is a partial enlarged view showing the variable injection hole type fuel injection nozzle shown in FIG. 1.

On the other hand, a guide hole 300 coaxial with the first hole 100*a* of the nozzle holder body 1, and an oil reservoir 301 greater in diameter than the guide hole 300 are formed in the shaft center of and from the upper end to the lower end of the nozzle body 3. Further, a leading hole 302 relatively smaller in diameter than the guide hole 300 is bored under the oil reservoir 301, and a conical seat face 303 is formed at the lower end of the leading hole 302. Further, a hole 304 through which pressurized fuel is guided is formed continuously with respect to the seat face 303 as shown in FIG. 2.

The hole 304 has a shaft hole which stops before reaching the leading end face of the injection hole part 32, whereby the shaft hole forms a closed-end hole.

A pressurized fuel port 104 to be connected to an inlet connector is provided on one side of the nozzle holder body 1 and communicates with the oil reservoir 301 via the nozzle holder body 1 and passage holes 105, 305 bored in the nozzle body 3, so that high-pressure fuel is guided therethrough.

A mating part 41 for mating with the push rod 101 is fitted to the upper end of the needle valve 4, and a guide 5 portion 40 slidable on the guide hole 300 is also fitted to the outer periphery thereof. Further, a pressure receiving part 42 for receiving fuel pressure in the oil reservoir 301 is provided at the end of the guide portion 40, and a small-diameter shaft portion 43 for use in forming a tubular fuel passage A is provided from beneath the pressure receiving part 42 as shown in FIG. 2. A conical seat face 44 to be attached to and detached from the seat face 303 is also formed at the lower end of the small-diameter shaft portion 43.

A plurality of injection holes communicating with the hole 304 are each disposed in a plurality of different circumferences of the peripheral wall of the injection hole part 32 surrounding the hole 304 as shown in FIGS. 2 and 3A to 3C.

More specifically, according to this embodiment of the invention, there are four upper injection holes 34 bored at intervals of 90° in a circumferential area relatively close to the base of the injection hole part, four intermediate injection holes 35 bored in phase with the upper injection holes 34 in a circumferential area separated axially by a predetermined space from the upper injection holes 34, and four lower injection holes 36 bored in phase with the intermediate injection holes 35 in a circumferential area separated axially by a predetermined space from the intermediate injection holes 35. In other words, there are 12 injection holes in this example.

The aforementioned upper, intermediate and lower injection holes 34, 35 and 36 are set parallel to or properly sloped down the respective nozzle axial lines. Moreover, the upper, intermediate and lower injection holes 34, 35 and 36 have the same diameter at the levels to which these injection holes belong, respectively. However, the diameters of the upper, intermediate and lower injection holes 34, 35 and 36 differ from one another.

Given that the diameter of the upper injection hole 34 is d1; that of the intermediate injection hole 35, d2; and that of lower injection hole 36 is d3, their mutual relation is defined by d1<d2<d3. For example, the respective diameters of $d_1$ to $d_3$ and $D_1$ to $D_3$ are set so that $d_1$ is 0.1 mm, $d_2$ is 0.2 mm and $d_3$ is 0.3 mm, and $D_1$ is 0.4 mm, $D_2$ is 0.3 mm and $D_3$ is 0.5 mm.

A rotary valve 7 is precisely fitted into the hole 304. The rotary valve 7 is adapted to rotating at a predetermined angle of rotation by a driving shaft system 8 passing through the needle valve 4 and the adjusting screw 102, and an actuator 9 fitted to the driving head 2.

More specifically, a first hole 45*a* is axially formed from the lower end up to the middle position of the needle valve 4; a second hole 45*b* thinner than the first hole 45*a* is formed from the end of the first hole 45*a;* a third 45*c* substantially equal in diameter to the first hole 45*a* is formed from the end of the second hole 45*b* up to the upper end of the push rod 101; and a fourth hole 45*d* is formed from the lower end up to the upper end of the adjusting screw 102. The upper end region of the fourth hole 45*d* is suitably tapered so as to prevent the deflection of the driving shaft.

The driving shaft system 8 is equipped with a driving shaft body 8*a* reaching the driving head 2, a coupling shaft 8*b* and a coupling 10 according to this embodiment of the invention.

The driving shaft body 8*a* is long enough to range from the fourth hole 45*d* up to the lower end region of the third hole 45*c*, and properly thinner in diameter than the third hole 45*c*.

The coupling shaft 8*b* has a large diameter portion 80 (area seal portion) rotatably and precisely fitting into the first hole 45*a* so as to function as a sealing portion, and a small-diameter portion 81 is idly and continuously fitted into the second hole 45*b* from the end to the upper portion of the large-diameter portion 80. Consequently, a stepped stopper part 82 is formed on the boundary between the small- and large-diameter portions 81, 80 and by contacting the upper end face of the first hole 45*a*, the stepped stopper part 82 is adapted to moving up and down together with the needle valve 4. Further, the upper end of the small-diameter portion 81 and the lower end of the driving shaft body 8*a* are coupled together so that the torque is transmitted thereto through, for example, Oldam's coupling parts 811, 801 which allow an axial backlash.

The lower edge face of the rotary valve 7 is kept in contact with the base of the hole 304, and the rotary valve 7 is also coupled to the large-diameter portion 80 of the coupling shaft 8*b* via the coupling 10 allowing the axial backlash in this state. The rotary valve 7 is long enough to reach the first hole 45*a* of the needle valve 4 according to this embodiment of the invention.

While the coupling 10 is allowing the lateral motion and machining tolerance on axial dimensions of the rotary valve 7 and the coupling shaft 8*b*, and the axial backlash of the rotary valve 7 resulting from the lifting of the needle valve, it operates to transmit rotary torque and holding torque to the rotary valve 7. In this case, an Oldam's coupling is employed.

The coupling 10 has an outer diameter smaller than the diameter of the first hole 45*a;* a projection 800 extending from the lower end of the large-diameter portion of the coupling shaft 8*b* is fitted into a groove 10*a* in its upper half portion; and a projection 10*b* in the lower half portion 90° out of phase with the groove 10*a* is fitted into a groove 70 formed at the upper end of the rotary valve 7.

Needless to say, the relation between the projection and the groove may be reversed and in this case a groove is formed in the large-diameter portion 80 of the coupling shaft 8*b*, whereas a projection is provided on the upper end of the rotary valve 7. Further, the coupling may be such that its upper and lower half portions are in the form of a projection or a groove and in this case the coupling shaft 8*b* and the rotary valve 7 are each provided with corresponding grooves or projections.

The actuator 9 is securely installed in a cavity 200 provided in the driving head 2. The actuator 9 may be of any type as long as it is rotatable (preferably reversibly rotatable) and can be held at a predetermined position of rotation; for example, a stepping motor or a servo motor is employed. Moreover, gears 90, 91 as transmission elements are secured to the output shaft and the upper end of the driving shaft body 8*a*, these gears engaging with each other. For example, spur gears are preferred for the purpose as long as their axial displacement is allowed.

However, the driving shaft body 8*a* may be coupled to the output shaft of the actuator 9 directly via an axial flexible coupling.

The rotary valve 7 is rotatably fitted into the hole 304, and a plurality of radial holes 71 are provided in a region of the rotary valve facing the fuel passage A. These radial holes 71 communicate with a fuel passage hole 72 bored in the axial direction of the rotary valve.

Further, a plurality of fuel guide holes communicating with the upper, intermediate and lower injection holes 34, 35 and 36 provided in the injection hole part 32 of the nozzle body 3 are each bored in the different circumferential places of the rotary valve 7.

More specifically, there are four upper fuel guide holes 74 provided at intervals of 90° at a circumferential position corresponding in height to the upper injection holes 34, four intermediate fuel guide holes 75 provided at intervals of 90° at a circumferential position corresponding in height to the intermediate injection holes 35, and four lower fuel guide holes 76 provided at intervals of 90° at a circumferential position corresponding in height to the lower injection holes 36.

The upper fuel guide hole 74, the intermediate fuel guide hole 75 and the lower fuel guide hole 76 may be equal or different in diameter. Given that the diameter of the upper fuel guide hole 74 is D1, that of the intermediate fuel guide hole 75 D2 and that of the lower fuel guide hole 76 D3 according to this embodiment of the invention, D1 <D2 <D3 is established.

However, the smallest diameter of each of the fuel guide holes 74, 75 and 76 must be equal to or greater than the largest diameter of each of the injection holes 34, 35 and 36 in any case. When the needle valve 4 is completely lifted, moreover, the diameter of each fuel guide hole needs to be great enough to thoroughly communicate with the injection hole used for fuel injection even though the rotary valve 7 moves within the axial backlash range or rotates because of the backlash in the direction in which the coupling 10 rotates.

Although all the fuel guide holes are normally kept communicating with the fuel passage hole 72, the upper fuel guide hole 74, the intermediate fuel guide hole 75 and the lower fuel guide hole 76 are set to stand in such a relationship to the injection holes that while one or more than one circumferential fuel guide hole communicates with the corresponding circumferential injection holes, irrespective of the rotary position of the rotary valve 7, the other remaining fuel guide holes are not allowed to communicate with the injection holes as shown in FIGS. 4A to 4I.

FIGS. 4A to 4I show the development of the relationship between the injection hole and the fuel guide hole when the rotary valve 7 is rotated 10° each time from 0° up to 80° in a case where the intermediate injection hole 35 is set twice as great in diameter as the upper injection hole 34, where the lower injection hole 36 is set 1.5 times as great in diameter as the intermediate injection hole 35 and where the upper, intermediate and lower fuel guide holes 74, 75, 76 are circumferentially set 30° out of phase one another.

Figure 4A:
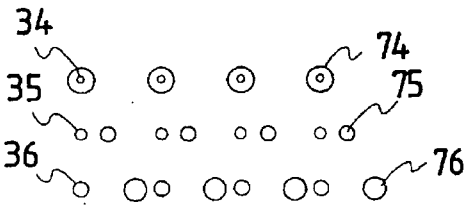
FIGS. 4A to 4I are diagrams illustrating a relationship between the injection hole and the fuel guide hole when the rotary valve is rotated by 10° each time it is rotated up to 0°–80°, respectively.
Figure 4B:
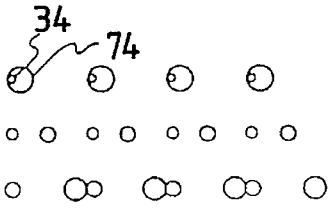
Figure 4C:
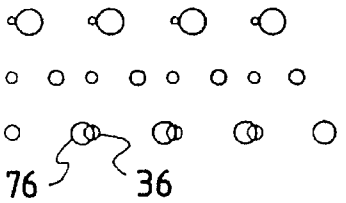
Figure 4D:
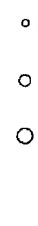
Figure 4E:
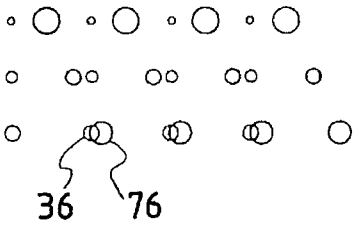
Figure 4F:
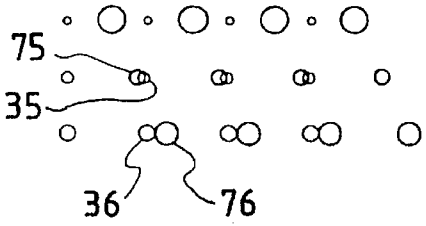
Figure 4G:
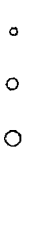
Figure 4H:
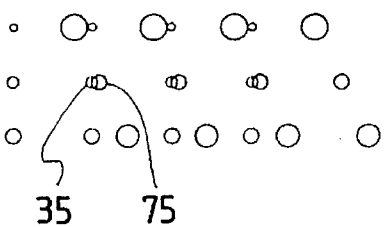
Figure 4I:
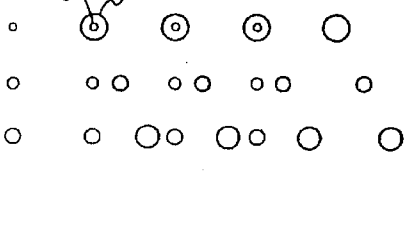

In FIG. 4A, the upper injection hole 34 and the upper fuel guide hole 74 communicate with each other; in FIG. 4B, the upper injection hole 34 and the upper fuel guide hole 74 communicate with each other, whereas the lower injection hole 36 and the lower fuel guide hole 76 are brought into closer relationship so as to communicate slightly with each other; in FIG. 4C, the lower injection hole 36 and the lower fuel guide hole 76 communicate with each other half-and-half; in FIG. 4D, the lower injection hole 36 and the lower fuel guide hole 76 only communicate with each other; in FIG. 4E, the lower injection hole 36 and the lower fuel guide hole 76 communicate with each other half-and-half; in FIG. 4F, the lower injection hole 36 and the lower fuel guide hole 76 communicate slightly with each other, whereas the intermediate injection hole 35 and the intermediate fuel guide hole 75 start communicating with each other; in FIG. 4G, the intermediate injection hole 35 and the intermediate fuel guide hole 75 communicate with each other; and in FIG. 4H, the upper injection hole 34 and the upper fuel guide hole 74 communicate with each other.

Figure 5A:
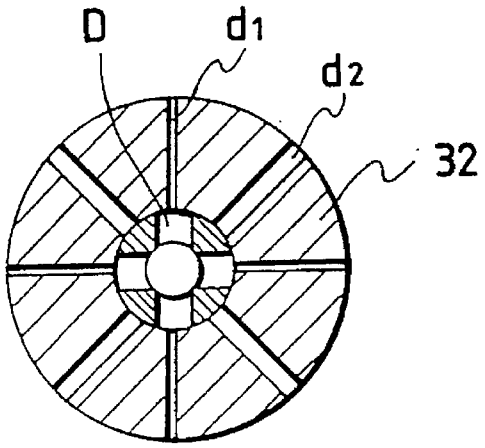
FIGS. 5A and 5B are diagrams exemplarily illustrating the condition under which the injection hole communicates with the fuel guide hole, irrespective of the rotary position of the rotary valve, respectively.
Figure 5B:
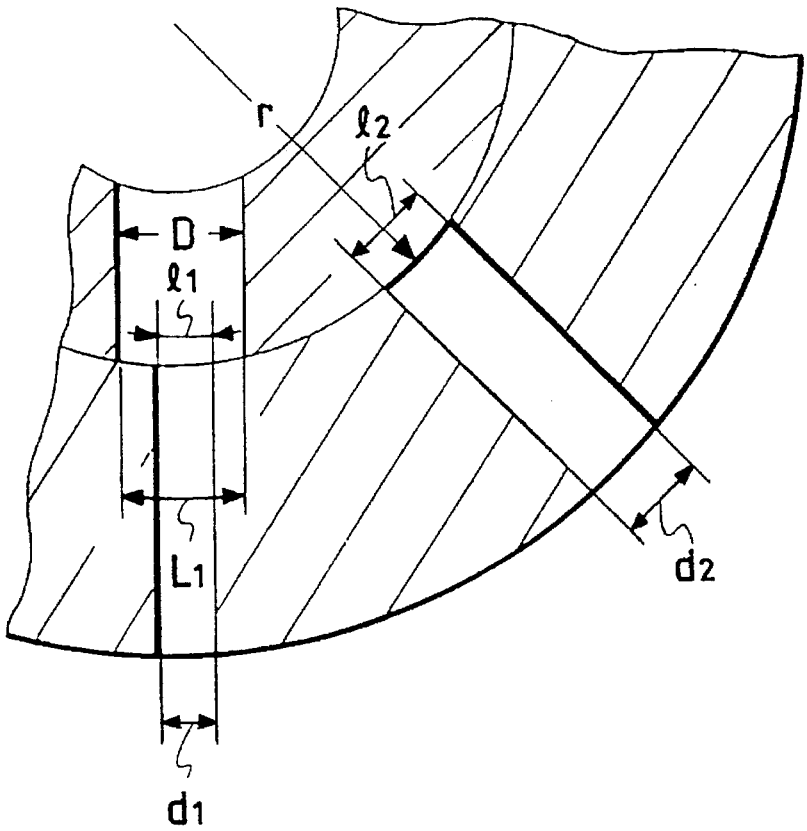

As noted previously, one or more than one circumferential fuel guide hole communicates with the corresponding circumferential injection holes, irrespective of the rotary position of the rotary valve 7, whereas the other remaining fuel guide holes are not allowed to communicate with the injection holes. FIG. 5 illustrates the relationship above.

More specifically, the following equation (1) should be established when the injection holes are arranged on a level with a position where the diameter of a hole for making the rotary valve 7 communicate with the injection hole is maximized in cross section, $$L1+L2+\ldots+Lm>2\pi\tau-l1-l2-\ldots-ln \quad (1)$$

where the diameter of the fuel guide hole of the rotary valve=D, the diameters of the injection holes=d1, d2 . . . dn, the circumferential lengths of the fuel guide holes on the circumferential boundary between the rotary valve and the injection hole=L1, L2 . . . Lm, the circumferential lengths of the injection holes on the circumferential boundary between the rotary valve and the injection hole=l1, l2 . . . ln, the radius of the boundary between the rotary valve and the injection hole=τ, the number of injection holes=n, and the number of fuel guide holes=m.

In a case where the injection holes and the fuel guide holes are provided circumferentially in a multistage mode, the whole injection hole is projected on a given circumferential face to apply Eq. (1); in other words, the relationship therebetween should satisfy the following equation (2):

$$\Sigma Lm>2\pi\tau-\Sigma Ln \quad (2)$$

where ΣLm=the whole projection length in the circumferential direction of the fuel guide hole on the boundary circumference between the rotary valve and the injection hole, and ΣLn=the whole projection length in the circumferential direction of the injection hole on the boundary circumference between the rotary valve and the injection hole.

The relationship like this can be set optionally by combining the diameters of the injection hole and the fuel guide hole with the circumferential phase.

FIGS. 6 to 9 inclusive, show a second aspect of the first embodiment of the invention.

In this aspect of the embodiment of the invention, six upper injection holes 34 are circumferentially bored at intervals of 60° relatively close to the base of a injection hole part, and six intermediate injection holes 35 are circumferentially bored away from the upper injection holes 34 at axially predetermined intervals in phase with the upper injection holes 34. Further, six lower injection holes 36 are circumferentially bored away from the intermediate injection holes 35 at axially predetermined intervals in phase with the intermediate injection holes 35. Therefore, the number of injection holes is 18 in this case.

The six upper injection holes 34 are equal in diameter and this is also the case with the six intermediate injection holes 35 and the six lower injection holes 36. However, the upper injection hole 34, the intermediate injection hole 35 and the lower injection hole 36 are different in diameter from one another and the relationship among them is defined by d1>d2>d3 according to this embodiment of the invention where the diameter of the upper injection hole 34=d1, the diameter of the intermediate injection hole 35=d2 and the diameter of the lower injection hole 36=d3.

Moreover, there are six upper fuel guide holes 74 circumferentially provided at intervals of 60° at a height corresponding to the upper injection holes 34, six intermediate fuel guide holes 75 circumferentially provided at intervals of 60° at a height corresponding to the intermediate injection holes 35, and six lower fuel guide holes 76 circumferentially provided at intervals of 60° at a height corresponding to the lower injection holes 36. In this example, the six upper fuel guide holes 74 are equal in diameter and this is also the case with the intermediate fuel guide holes 75 and the lower fuel guide holes 76. The upper, intermediate and lower fuel guide holes 74, 75, 76 are circumferentially set 20° out of phase one another.

Although the rest may be similar in constitution to the preceding aspect, the hole 304 in this aspect has a large-diameter portion 304*a* and a shaft hole 304*b* whose diameter is relatively smaller than that of the former, and the shaft hole which stops before reaching the leading end face of the injection hole part 32, whereby the shaft hole forms a closed-end hole.

Moreover, the rotary valve 7 is precisely and rotatably fitted into the shaft hole 304*b* of the hole 304, and an annular fuel passage B which communicates with the fuel passage A when the needle valve 4 is opened is formed between the outer periphery of the fuel passage A and the large-diameter hole portion 304*a* of the hole 304. The plurality of radial holes 71 are provided in a region of the rotary valve facing the annular fuel passage B, and these radial holes 71 communicate with the fuel passage hole 72 bored in the axial direction of the rotary valve.

Figure 10:
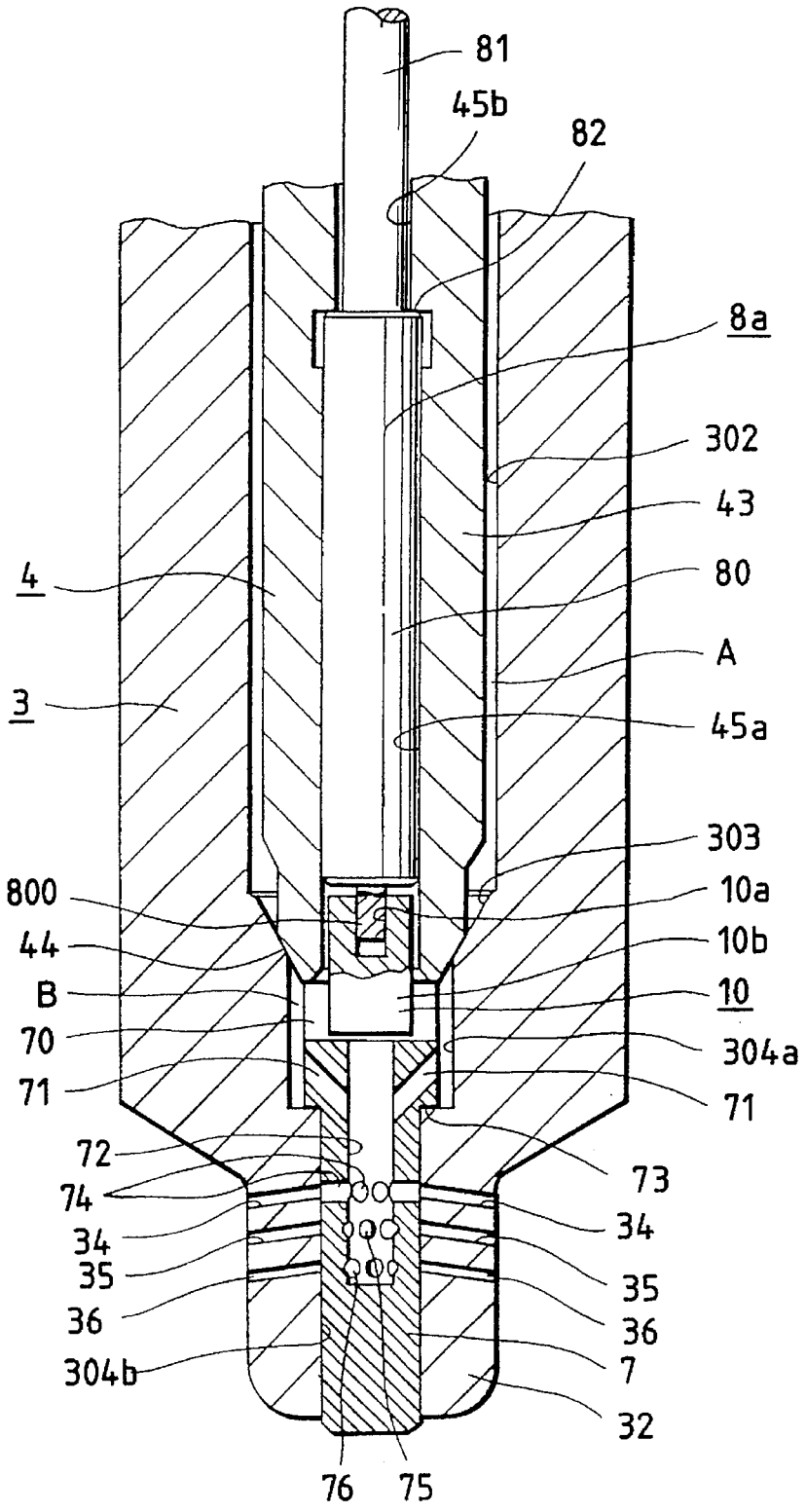
FIG. 10 is a partial enlarged sectional view showing a variable injection hole type fuel injection nozzle according to a second embodiment of the present invention.

FIG. 10 is a partial enlarged sectional view of a second embodiment of the present invention.

According to the second embodiment of the invention, the hole 304 has the large-diameter portion 304*a* and the shaft hole 304*b* whose diameter is relatively smaller than that of the former, the shaft hole 304*b* passing through the base of the injection hole part 32.

The rotary valve 7 is such that its upper end portion is coupled via the coupling 10 to the large-diameter portion 80 of the coupling shaft 8*b*, whereas its lower end portion is passed through the shaft hole 304*b*. Further, the rotary valve 7 has a head part 73 having an enlarged-diameter and located lower than the coupling 10, and the annular underside of the head part 73 is in contact with the large-diameter portion 304*a*, whereby the coupling 10 is prevented from slipping off.

Since the shaft hole 304*b* is passed through the injection hole part 32 according to the second embodiment of the invention, the advantage is that the hole 304 is readily bored.

Since the rest is similar in constitution to the first embodiment of the invention, like reference characters are given to the like or corresponding parts or portions, and the description thereof will be omitted.

Figure 11:
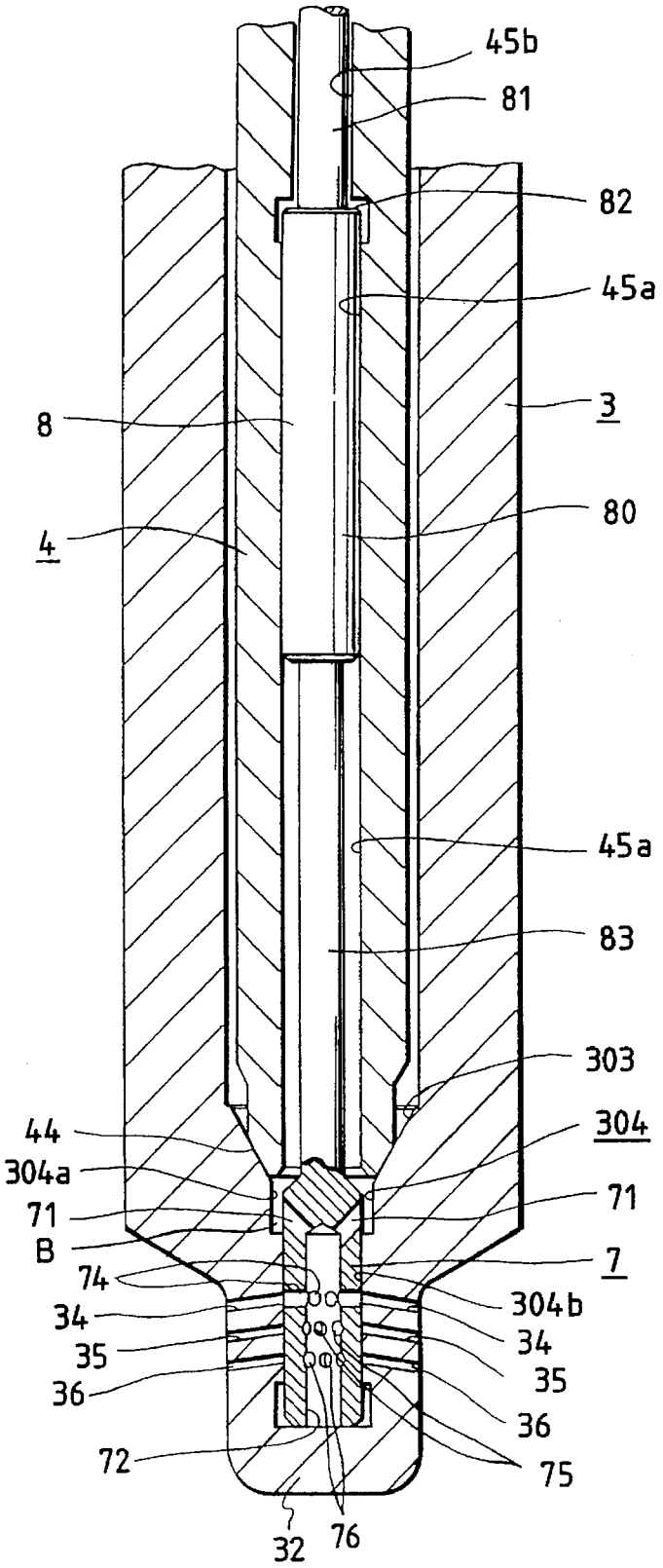
FIG. 11 is a partial enlarged sectional view showing a variable injection hole type fuel injection nozzle according to a third embodiment of the present invention.

FIG. 11 is a partial enlarged sectional view of a third embodiment of the present invention.

According to this embodiment of the invention, the coupling shaft 8*b* and the rotary valve 7 are directly coupled without using the coupling 10.

More specifically, the coupling shaft 8*b* has the large-diameter portion 80 rotatably and precisely fitted into the first hole 45*a* of the needle valve 4 to prevent fuel leakage as in the preceding embodiment of the invention, the small-diameter portion 81 idly fitting into the second hole 45*b* and extending upward from the end of the large-diameter portion 80, and the stepped stopper part 82 formed on the boundary between the small- and large-diameter portions 81, 80. Further, the coupling shaft 8*b* has a slender shaft portion 83 which is sufficiently thin with respect to the first hole 45*a* and extends downward from the lower end of the large-diameter shaft portion 80, and the rotary valve 7 is continuously coupled to the lower end of the slender shaft portion 83.

The slender shaft portion 83 and the rotary valve 7 are normally formed integrally with a rotary shaft 8. However, the slender shaft portion 83 and the rotary valve 7 may be formed separately from the coupling shaft 8*b* as occasion demands, so that they are integrated into one body by welding, press-fitting or screwing.

The second embodiment of the invention is advantageous in that the number of parts can be reduced as no coupling is employed and moreover that fabrication is facilitated because the shifting of the shaft center can be absorbed by the elastic deformation of the slender shaft portion 83.

Since the rest is similar in constitution to the first embodiment of the invention, like reference characters are given to the like or corresponding parts or portions, and the description thereof will be omitted.

FIGS. 12 to 15 inclusive, refer to a fourth embodiment of the present invention.

According to this embodiment of the invention, there is provided an injection-hole closing mechanism for shutting off the communication of the hole 304 with an engine cylinder except for the time fuel injection is carried out so as to prevent after-dripping.

For the purpose, the hole 304 is of closed-end structure as in the third embodiment of the invention and moreover the rotary valve 7 is directly coupled to the driving shaft body 8*a* without using the coupling 10 and the coupling shaft 8*b*. In other words, the driving shaft system 8 is formed with only the driving shaft body 8*a* according to this embodiment of the invention.

Figure 12:
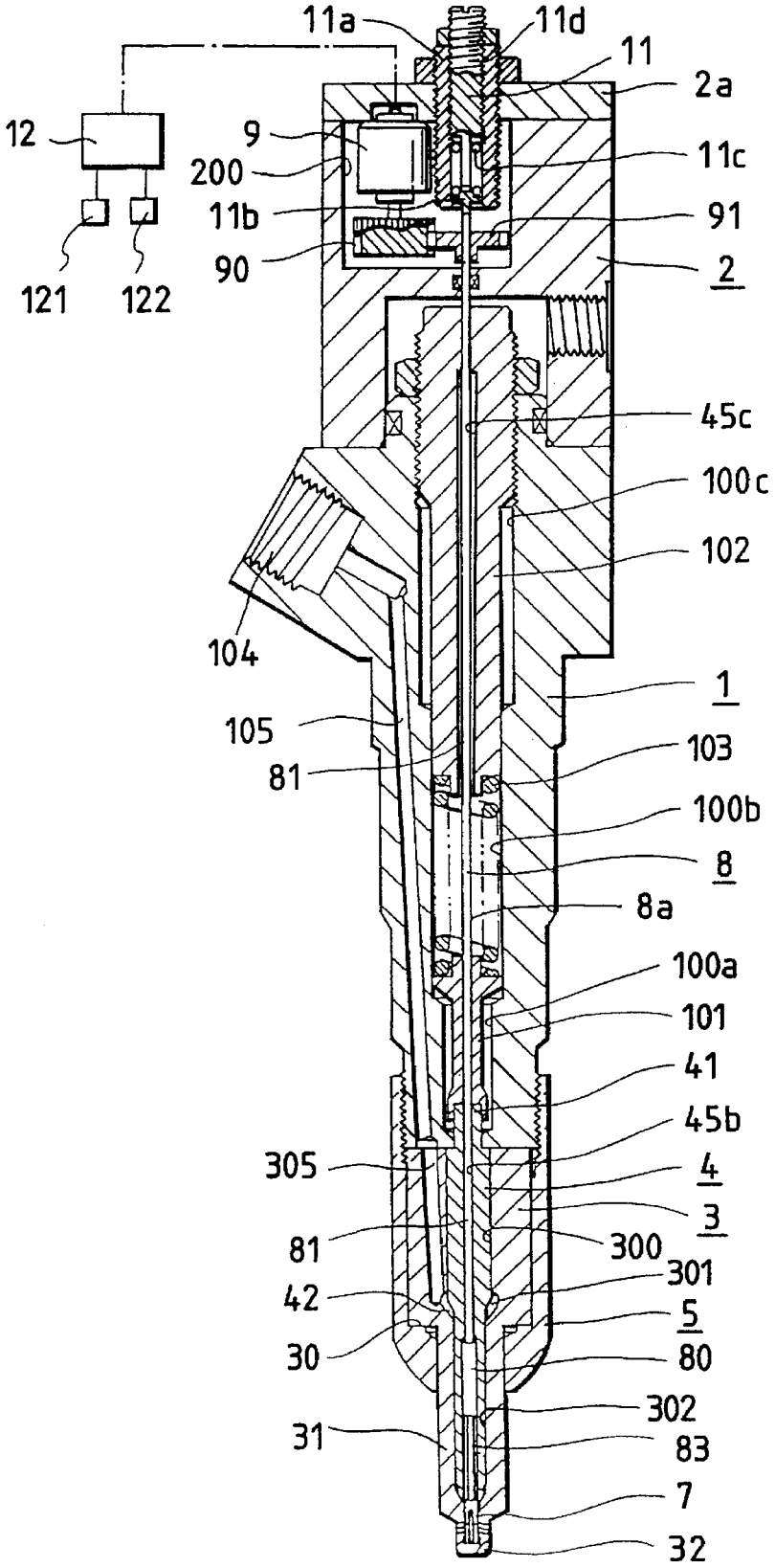
FIG. 12 is a vertical side view showing a variable injection hole type fuel injection nozzle according to a fourth embodiment of the present invention.
Figure 13:
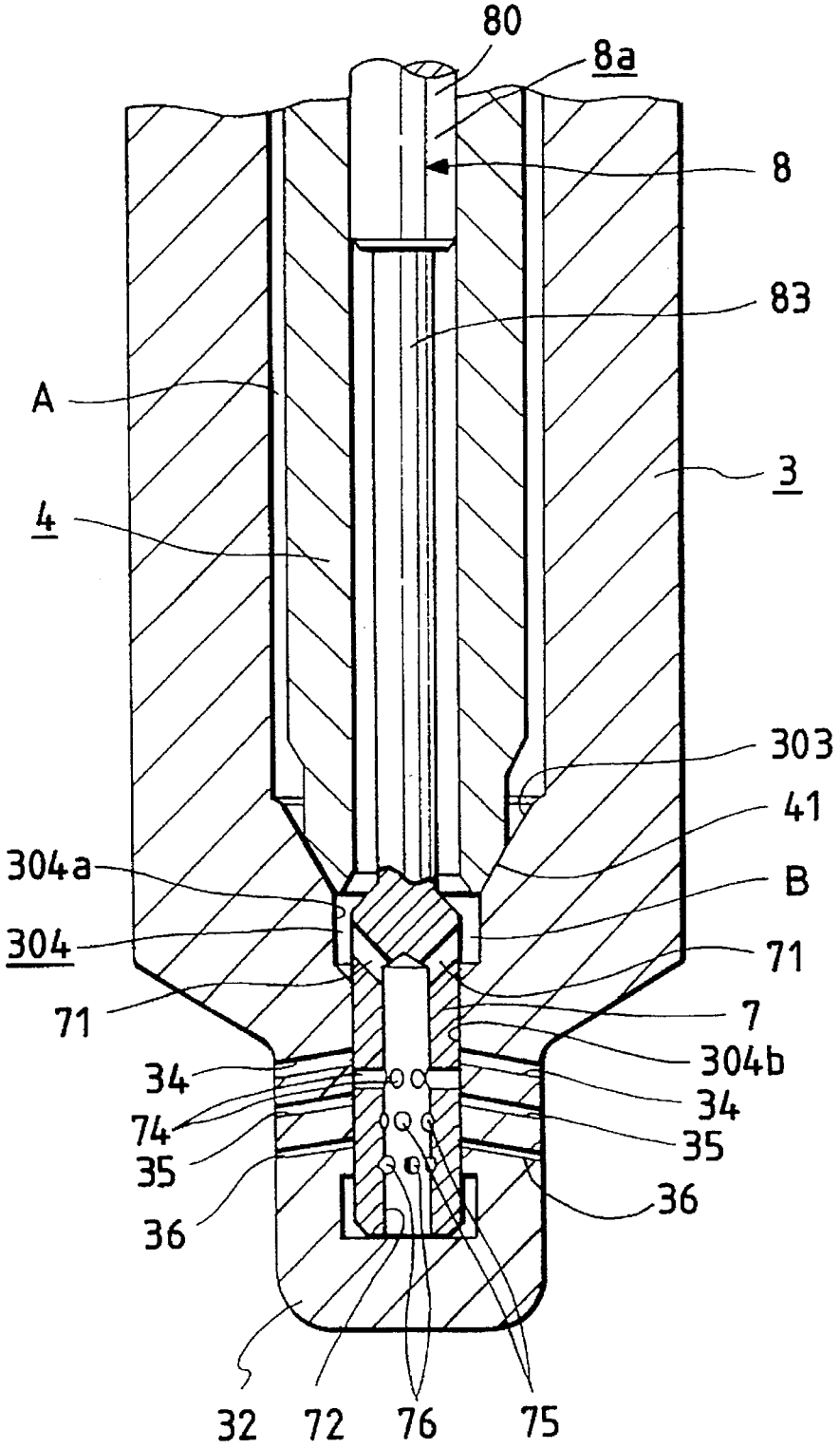
FIG. 13 is a partial enlarged view of FIG. 12.

Unlike the first through third embodiments of the invention in which the upper fuel guide hole 74 and the upper injection hole 34, the intermediate fuel guide hole 75 and the intermediate injection hole 35, and the lower fuel guide hole 76 and the lower injection hole 36 are each put in phase with one another in the axial direction, the upper fuel guide hole 74, the intermediate fuel guide hole 75 and the lower fuel guide hole 76 are each intentionally out of phase with the upper injection hole 34, the intermediate injection hole 35 and the lower injection hole 36 in the axial direction in such a state that the lower end of the rotary valve 7 is in contact with the base of the hole 304 according to the fourth embodiment of the invention as shown in FIGS. 12 and 13.

In other words, the upper fuel guide hole 74 is situated at a level lower than that of the upper injection hole 34; the intermediate fuel guide hole 75 at a lever lower than that of the intermediate injection hole 35; and the lower fuel guide hole 76 at a level lower than that of the lower injection hole 36.

Figure 15:
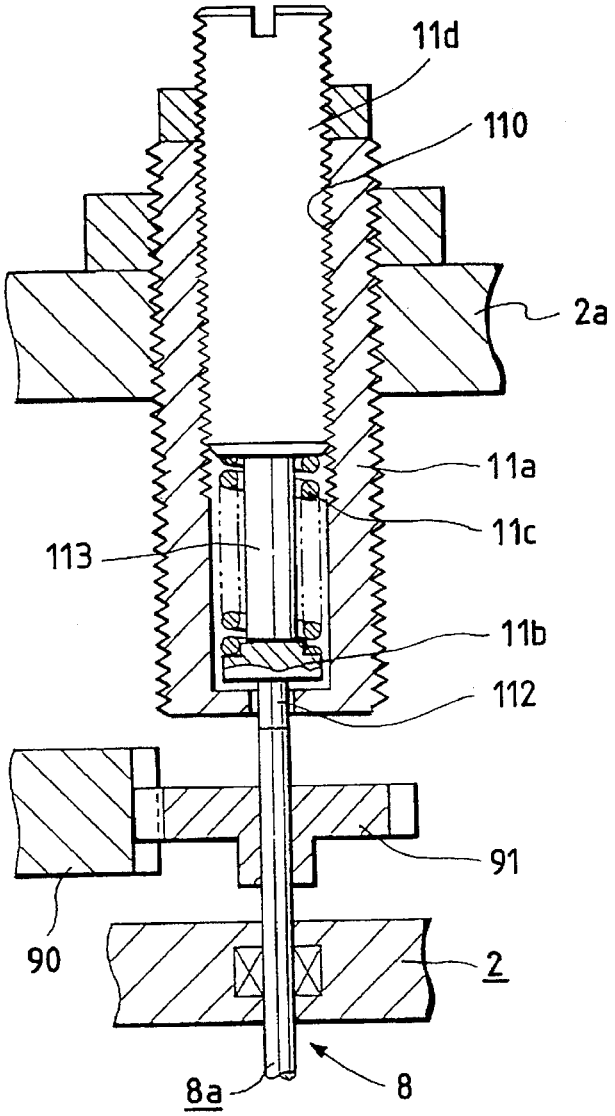
FIG. 15 is a sectional view showing a state of the leading and trailing end portions of the injection nozzle at the time fuel is injected according to the fourth embodiment of the invention.
Figure 15:
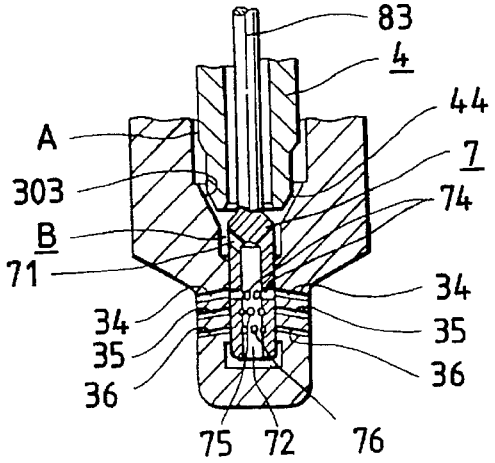

Further, the rotary valve 7 is set movable up and down so as to reach a level at which the fuel guide holes in each row are allowed to communicate with the corresponding fuel guide holes as shown in FIG. 15 for the first time the rotary valve 7 is lifted on receiving fuel pressure from the hole 304. A resilient press mechanism for forcing down the rotary valve 7 when the injection is terminated to restore it to the aforementioned injection shutting-off state is provided above the rotary valve 7.

According to this embodiment of the invention, a plug 11*a* facing the axial line of the driving shaft 8 is internally secured to a cover 2*a* for covering the cavity 200 of the driving head 2, and its base is provided with an internal thread hole 110 having a fine hole 111 in its base. Further, a spring seat 11*b* having a projection 112 projecting downward through the fine hole 111 is disposed at the base of the internal thread hole, and the lower end of a coil spring as a return spring 11*c* is mounted on the spring seat 11*b*. A stopper screw 11*d* having a stopper shaft 113 capable of abutting against the upper face of the spring seat 11*b* is screwed into the internal thread hole 110 so as to urge the spring seat 11*b* by compressing the return spring 11*c*.

In this case, it is needed for the force of urging the return spring 11*c* to be set so as to allow the rotary valve 7 to reach the upper limit position instantly due to injection pressure when the injecting operation is performed under any condition of injection and also to allow it to reach the lower limit position instantly when the injecting operation is terminated.

The setting above is fulfilled by adjusting the degree to which the stopper screw 11*d* is screwed in and the upper limit position of the rotary valve 7 is set by the stopper shaft 113 of the stopper screw 11*d*. In other words, the clearance c between the lower edge face of the stopper shaft 113 and the upper face of the spring seat 11*b* constitutes a driving shaft stroke.

Thus, a spur gear is employed since the transmission element 91 of the driving shaft 8 and the transmission element 90 of the output shaft of the actuator 9 have to allow the vertical movement of the driving shaft 8 as stated above.

In order to facilitate the control of the rotary position of the rotary valve 7, the projection 112 of the spring seat 11*b* is preferably supplied with a minute clearance (backlash stroke) c' with respect to the upper end of the driving shaft 8 while the rotary valve 7 is located at the lower limit position. This clearance c' may be adjusted by placing a shim between the lower face of the spring seat 11*b* and the base of the internal thread hole 110 or providing an outside screw for the plug 11*a* so as to adjust the engagement of the cover 2*a* with the internal thread.

However, a thrust bearing face may be provided as occasion demands and in this case the clearance c' is unnecessary.

Although the upper fuel guide hole 74, the intermediate fuel guide hole 75 and the lower fuel guide hole 76 may be equal or different in diameter, their diameters should be great enough so that these fuel guide holes are each able to communicate with the injection holes during the injecting operation even though the upper limit position of the rotary valve 7 slightly shifts in the axial direction or even though the angle of rotation of the rotary shaft 8 slightly shifts when the needle valve 4 is completely lifted.

Moreover, the rotary shaft 8 must not move up and down together with the needle valve 4 when the latter opens according to this embodiment of the invention, and unlike the first embodiment of the invention, the rotary shaft 8 has no stepped stopper part.

Since the rest is similar in constitution to the first embodiment of the invention, like reference characters are given to the like or corresponding parts or portions, and the description thereof will be omitted.

According to any one of the embodiments of the present invention, the rotary valve 7 is rotated by the actuator 9 during the time the engine is giving an intake or exhaust stroke, that is, during the time no force is axially applied by the pressure in the engine cylinder to the driving shaft 8.

In order to exert the rotational timing control like this actually, the actuator 9 is electrically connected to an external controller 12 as shown in FIGS. 1 and 12. The controller 12 includes CPU having an input unit for receiving a signal from a sensor 121 for detecting the number of revolutions (or an angle of rotation) of the engine or the fuel injection pump, and a circuit for applying a drive signal to the actuator 9 while the engine is giving the stroke above. Not only the number of revolutions thus detected but also the inner pressure of the cylinder may needless to say be made an input signal.

The controller 12 also receives a signal from a load detection sensor 121 such as a rack sensor of the fuel injection pump. Further, a predetermined drive quantity (a driving angle of rotation) based on the predetermined map formed from the load and the number of revolutions beforehand is given to the actuator 9.

According to the first aspect of the first embodiment of the invention, for example, the drive quantity is given so that the positions of the upper injection holes 34 are switched to those corresponding to the upper fuel guide holes 74 at the time of low speed and light load; the positions of the intermediate injection holes 35 are switched to those corresponding to the intermediate fuel guide holes 75 at the time of intermediate speed and intermediate load; and the positions of the lower injection holes 36 are switched to those corresponding to the lower fuel guide holes 76 at the time of high speed and heavy load. According to the second aspect of the first embodiment thereof, the drive quantity is given so that the positions of the lower injection holes 36 are switched to those corresponding to the lower fuel guide holes 76 at the time of low speed and light load; the positions of the intermediate injection holes 35 are switched to those corresponding to the intermediate fuel guide holes 75 at the time of intermediate speed and intermediate load; and the positions of the upper injection holes 34 are switched to those corresponding to the upper fuel guide holes 74 at the time of high speed and heavy load.

The present invention is not limited to 4-injection-holes×3-stage switching and 6-injection-holes×3-stage switching according to the embodiments described above but may be implemented with upper and lower injection holes, and upper and lower fuel guide holes in two rows or otherwise in not less than four rows. Moreover, the number of injection holes and that of fuel guide holes on the same circumferential level are not limited to four or six but may be greater or less than four.

Moreover, the size of the injection hole diameter is optional, that is, may be arranged like upper injection hole<intermediate injection hole<lower injection hole, or intermediate injection hole>upper injection hole>lower injection hole, or otherwise intermediate injection hole>lower injection hole>upper injection hole. This is applicable to the fuel guide holes likewise.

Although the hole 304 is formed so that it comprises the large-diameter hole portion 304*a* and the shaft hole 304*b* relatively smaller in diameter than the former according to the third and fourth embodiments of the invention, it may needless to say be so structured as shown in FIG. 2.

Further, the injection holes and the fuel guide holes even according to the second through fourth embodiments of the invention are needless to say so related as to satisfy Eq. (2) according to the first embodiment of the invention.

A description will subsequently be given of the functions of the embodiments of the present invention.

According to the first and second embodiments of the invention, the pressurized fuel is supplied from a fuel injection pump (not shown) via piping to the pressurized fuel port 104, and forced via the passage holes 105, 305 into the oil reservoir 301 before being made to flow down through the annular fuel passage A.

The fuel pressure simultaneously acts on the pressure receiving face 42 of the needle valve 4 located in the oil reservoir 301 and when the fuel pressure reaches a level at which it overcomes the setting force of the spring 103, the needle valve 4 is lifted, whereby the seat face 44 at the lower end of the needle valve separates from the seat face 303 of the nozzle body 3, thus causing the needle valve to open. Then the pressurized fuel is introduced into the hole 304 and flows from the radial holes 71 of the rotary valve into the fuel passage hole 72. When the needle valve is lifted, the coupling shaft 8*b* moves together with the needle valve 4 according to the first embodiment of the invention.

The number of revolutions (or angle of rotation) and the load of the engine or the fuel injection pump are input to the sensors 121 and 122 from the controller 12, and the drive signal is sent from the controller 12 to the actuator 9 during the intake or exhaust stroke. The driving shaft body 8*a* is driven by the transmission element 91 meshing with the transmission element 90 of the output shaft in accordance with the desired angle of rotation obtained from the relationship between the load and the number of revolutions.

While the rotary valve 7 remains in the state of (a) shown in FIGS. 2, 3 and 4 in the first aspect of the first embodiment of the invention, that is, on the assumption that the upper fuel guide holes 74 and the upper injection holes 34 communicate with one another and that the fuel guide holes and the injection holes at the other two stages do not communicate with one another, the rotary valve 7 is not rotated when the controller 12 judges from rotational and load information that the engine is operated at low speed•light load.

Figure 6:
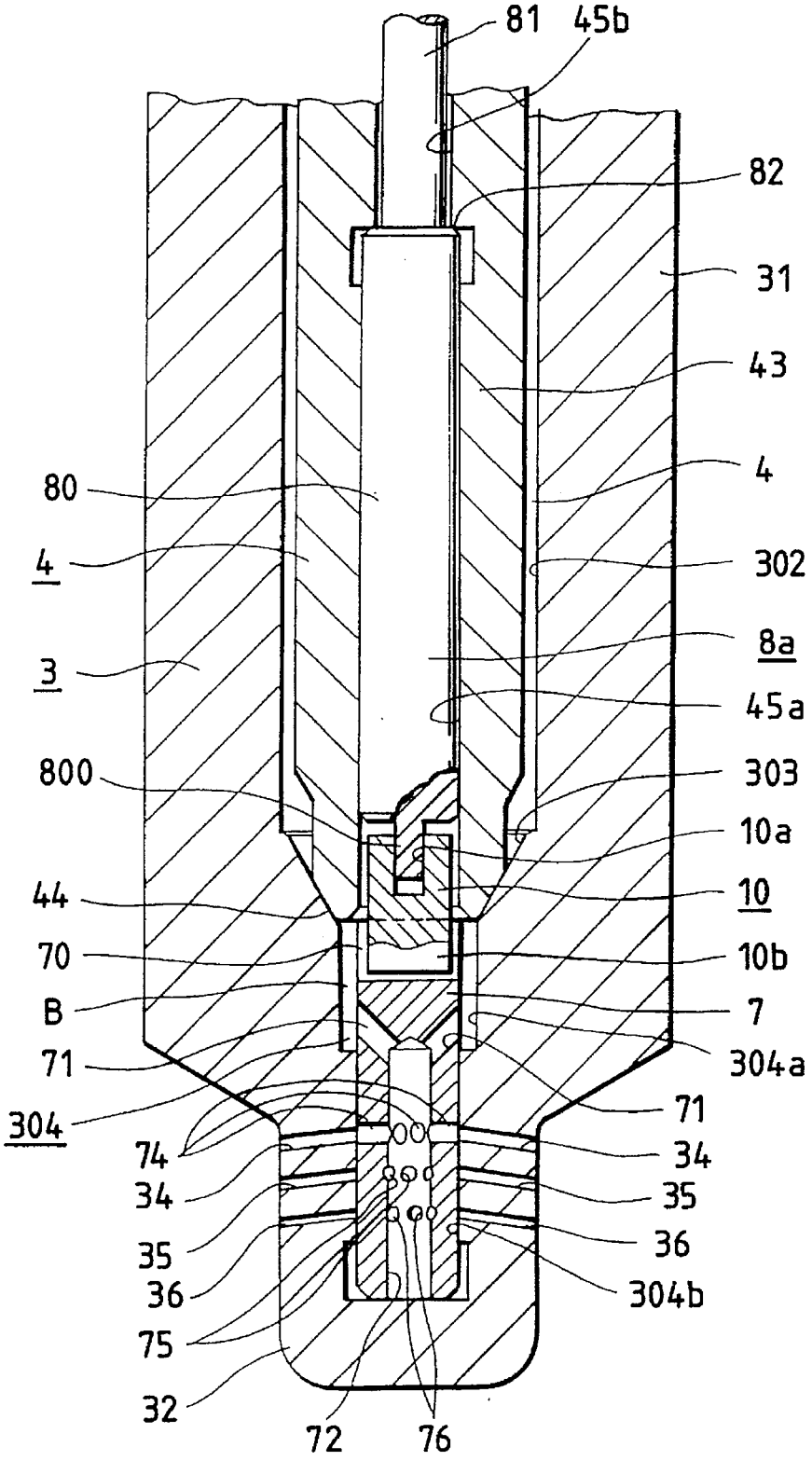
FIG. 6 is a partial enlarged view showing a variable injection hole type fuel injection nozzle according to the second aspect of the first embodiment of the invention.
Figure 7A:
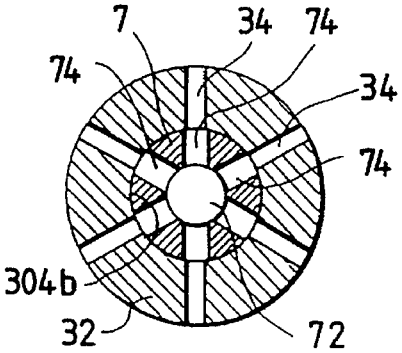
Figure 7B:
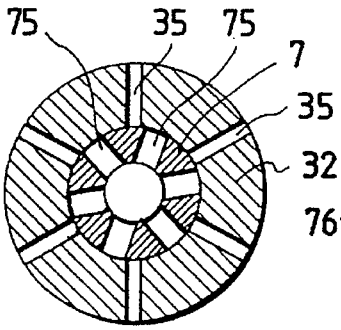
Figure 7C:
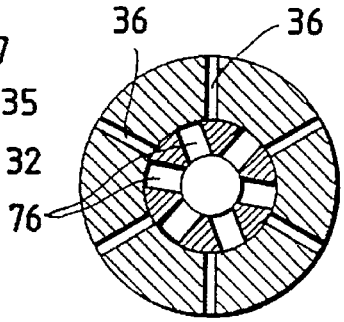

In the case of the second aspect of FIG. 6 and the second embodiment of the invention, a signal is applied to the actuator 9 while the upper fuel guide holes 74 and the upper injection holes 34 communicate with one another and while the fuel guide holes and the injection holes at the other two stages are not communicating with one another as shown in FIG. 7 and when the controller 12 judges from the rotational and load information that the engine is operated at low speed and light load. The rotary valve 7 is then rotated by 40° clockwise or by 20° counterclockwise and held at that position at that angle of rotation.

The rotation of the driving shaft body 8*a* is transmitted via the coupling 10 to the rotary valve 7, which rotates in such a state that it is precisely fitted into the hole 304. Even when the driving shaft body 8*a* is accompanied with the needle valve 4 while the latter is moving, the rotary valve 7 is held at the lower end position of the hole without axially moving to ensure that the torque is transmitted since the coupling 10 and the coupling parts 801, 811 allows their axial backlash.

Figure 9A:
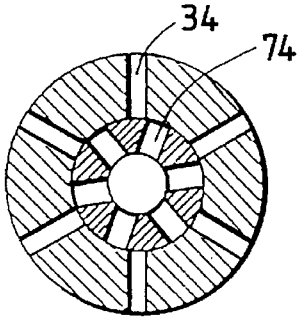
Figure 9B:
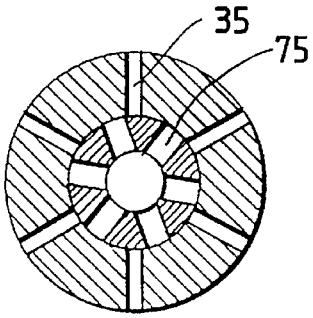
Figure 9C:
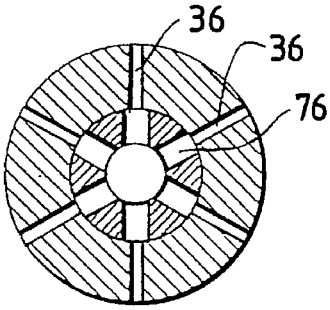

Because of the angle of rotation, the upper fuel guide hole 74 and the upper injection hole 34 are circumferentially out of phase with each other, and the intermediate fuel guide hole 75 and the intermediate injection hole 35 are also circumferentially out of phase with each other as shown in FIGS. 9A and 9B, whereby the upper and intermediate injection holes 34, 35 are practically closed. Therefore, each lower fuel guide hole 76 only conforms to the lower injection hole 36 and opens as shown in FIG. 9C.

Since the needle valve 4 remains open in that state, the pressurized fuel passes from the fuel passage hole 72 through the lower fuel guide hole 76 and is jetted from the lower injection hole 36 into the engine cylinder. As the diameter of the lower injection hole 36 is small, the fuel is greatly pressurized and jetted for a good length of time and atomized before being circumferentially sprayed in the form of thin mist. Therefore, a fuel-air mixture having a proper air-fuel ratio is generated and NOxz is reduced as delay in a catching-fire ratio is also reduced.

As the fuel pressure decreases, the needle valve 4 is forced down because of the urging force of the spring 103 and opened, and the fuel injection is terminated, whereby the coupling shaft 8*b* together with the needle valve 4 descends.

When the number of revolutions of the engine rises from that state, the drive signal is sent from the controller 12 to the actuator 9 during the intake or exhaust stroke according to the information obtained, the drive signal being intended for the predetermined angle of rotation in proportion to the load and the number of revolutions.

Regarding the driving shaft body 8*a* and the rotary valve 7 in the case of FIG. 2 of the first embodiment of the invention, the rotary valve 7 is rotated by 60° clockwise or 30° counterclockwise with reference to FIG. 4A and held at this position. Therefore, the intermediate fuel guide holes 75 and the injection holes 35 only conform to one another as shown in FIG. 4G.

Figure 8A:
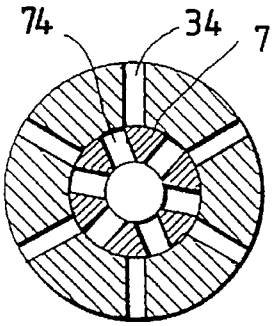
Figure 8B:
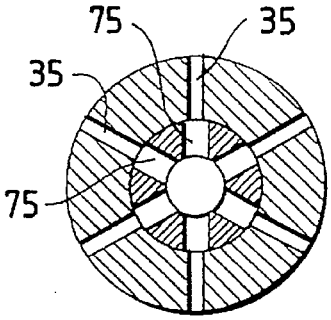
Figure 8C:
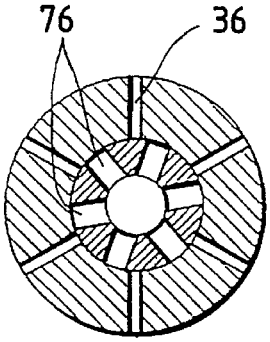

In the condition of FIG. 6 and according to the second and fourth embodiments of the invention, with respect to FIG. 7, the driving shaft body 8*a* and the rotary valve 7 are rotated by 40° clockwise or 20° counterclockwise. As shown in FIGS. 8A and 8C, the upper fuel guide holes 74 and the upper injection holes 34 are circumferentially out of phase with one another, and the lower fuel guide holes 76 and the lower injection holes 36 are circumferentially out of phase with one another, whereby the upper injection holes 34 and the lower injection holes 36 are each practically closed. Therefore, as shown in FIG. 8B, the intermediate fuel guide holes 75 and the intermediate injection holes 35 agree with one another and are kept open.

Since the intermediate injection hole 35 is greater in diameter than the lower injection hole 36, a quantity of injection is relatively increased, so that injection pressure and injection period matching the intermediate speed-intermediate load of the engine are created.

In such a state that the engine is operated at high speed-heavy load, the driving shaft body 8*a* and the rotary valve 7 in the case of FIG. 2 are rotated by 30° counterclockwise with reference to FIG. 4G during the intake or exhaust stroke according to the information obtained. In the aspect of the FIG. 6 and according to the second embodiment of the invention, the driving shaft body 8*a* and the rotary valve 7 are rotated by 20° clockwise or 40° counterclockwise.

Thus the injection holes having the relatively greatest opening are created. In other words, as shown in FIG. 4D, the lower fuel guide holes 76 and the injection holes 36 conform to one another or otherwise, as shown in FIG. 7A, the upper fuel guide holes 74 and the upper injection holes 34 communicate with one another, whereas the fuel guide holes and the injection holes on the other circumferential levels are out of phase with one another, whereby they are practically closed in this state.

A large quantity of fuel is therefore injected into the engine cylinder for a short time in conformity with the engine condition, whereby stable, high-output combustion is carried out. Thus, smoke becomes reducible.

The basic function according to the third embodiment of the invention is similar to what has been set forth above. Since the coupling shaft 8*b* and the rotary valve 7 are directly coupled together, the rotation of the rotary valve 7 is directly controlled.

When the needle valve 4 is lifted and opened, the pressurized fuel is forced in the tubular chamber between the slender shaft portion 83 and the first hole 45*a* to make the sectional area of the large-diameter shaft portion 80 a pressure receiving area, whereby the driving shaft 8 is slightly lifted.

However, it is preferred to size in diameter the upper, intermediate and lower fuel guide holes 74, 75 and 76 in consideration of the axial displacement of the rotary valve 7, thereby the injection holes 34, 35 and 36 can be made to communicate with the corresponding fuel guide holes at the corresponding stages.

Figure 14:
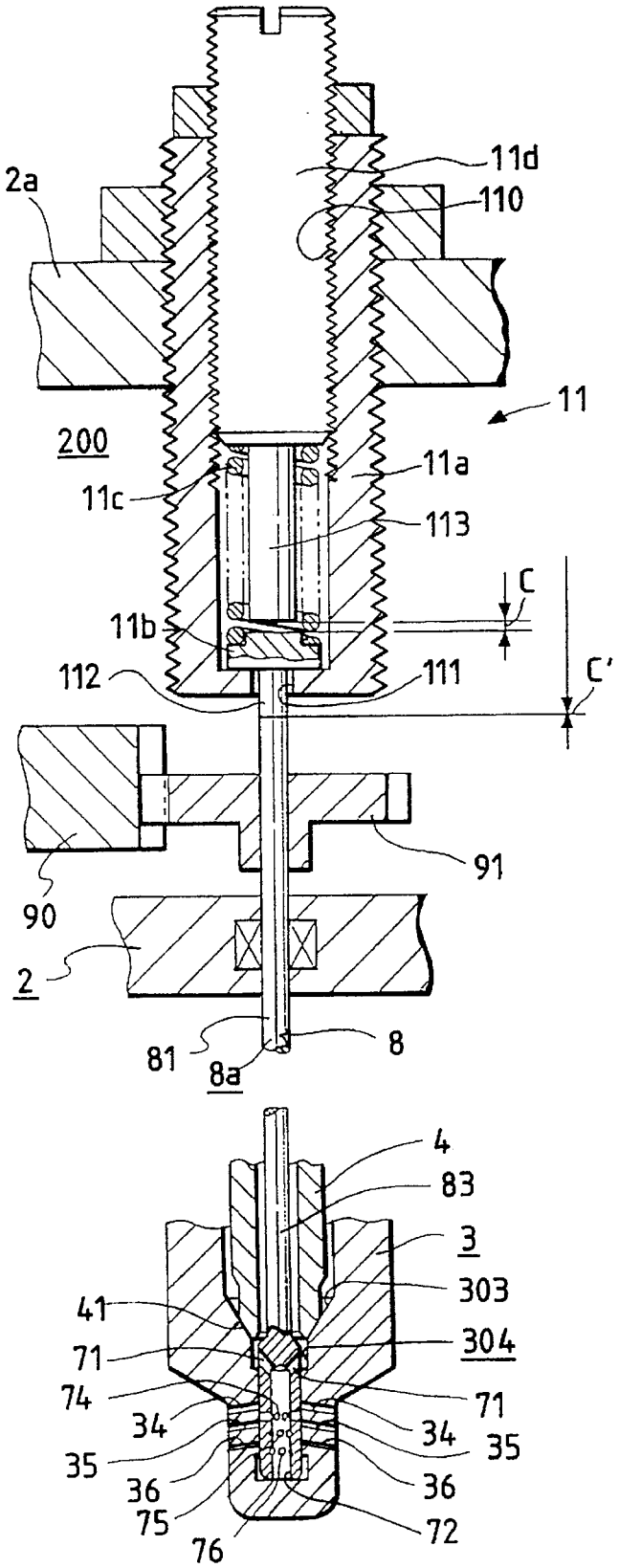
FIG. 14 is a sectional view showing a state of the leading and trailing end portions of the injection nozzle at the time no fuel is injected according to the fourth embodiment of the invention.

According to the fourth embodiment of the invention, the rotary valve 7 is located at the lower limit position as shown in FIGS. 13 and 14. In other words, the upper fuel guide hole 74, the intermediate fuel guide hole 75 and the lower fuel guide hole 76 are each put out of phase with the upper injection hole 34, the intermediate injection hole 35 and the lower injection hole 36. The injection holes 34, 35 and 36 at each stage are closed on the outer peripheral face of the rotary valve 7.

At this time, there exists a minute clearance c' between the upper end of the driving shaft body 8*a* and the projection 112 of the spring seat and no force is exerted by the return spring 11*c*. As a result, the driving shaft body 8*a* and the rotary valve 7 can be rotated by the actuator 9 with only a slight driving force. In other words, it is possible, during the intake or exhaust stroke, to match any one of the upper, intermediate and lower fuel guide holes 74, 75 and 76 and the corresponding injection hole circumferentially.

FIG. 14 refers to an angle of rotation at which the upper fuel guide hole 74 and the upper injection hole 34 match.

When the needle valve 4 is lifted and opened in the state described above, part of the pressurized fuel is forced into the tubular chamber between the slender shaft portion 83 and the first hole 45*a* to make the sectional area of the large-diameter shaft portion 80 a pressure receiving area, whereby driving shaft body 8*a* is instantly lifted.

Consequently, the stroke c' ceases to backlash to make the upper end of the driving shaft body 8*a* and the projected portion 111 of the spring seat contact each other, and the driving shaft body 8*a* is stopped from being lifted at the upper limit position where the stopper shaft 113 abuts against the spring seat 11*b* while the return spring 11*c* is compressed via the spring seat 11*b* to cause the rotary shaft to rise to an extent of stroke.

When the driving shaft body 8*a* and the rotary valve 7 are thus lifted because of the injection pressure, the upper fuel guide hole 74, the intermediate fuel guide hole 75 and the lower fuel guide hole 76 are axially put in phase with the upper injection hole 34, the intermediate injection hole 35 and the lower injection hole 36 respectively as shown in FIG. 15. Since their rotary positions have been set beforehand as noted previously, the upper fuel guide hole 74 and the upper injection hole 34 communicate with each other in this example as shown in FIG. 7. Thus the pressurized fuel is injected from the large-diameter injection hole 34 into the cylinder.

The needle valve 4 is forced up by the spring 103 at the time of injection and when the seat faces 44 and 303 are closed, the pressure within the hole 304 sharply drops. As a result, the force of the return spring 11*c* causes the driving shaft body 8*a* to move down, and the rotary valve 7 instantly moves to the lower limit position to restore the injection-hole closed condition as shown in FIG. 14, whereby the hole and the cylinder are stopped from communication with each other to ensure that not only after-dripping but also a rise in the exhaust temperature originating therefrom as well as the generation of soot due to incomplete combustion is prevented.

According to the fourth embodiment like the first embodiment of the invention, the drive signal which is not solely based on the number of revolutions (angle of rotation) and the load of the engine but also output from the controller 12 to the actuator 9 is used to select the group of injection holes; that is, the injection system shown in FIG. 8 is actuated when the intermediate injection holes are selected, whereas the injection system shown in FIG. 9 is employed when the lower injection holes are selected.

Since the injection holes 34, 35 and 36 are combined with the fuel guide holes 74, 75 and 76, respectively, to satisfy the aforementioned Eq. (2), the combination of injection holes and the fuel guide holes is always allowed to communicate one another as shown in FIG. 4, irrespective of the position of the rotary valve 7. Therefore, it is possible to secure a pressure escape route by changing the injection holes while the needle valve 4 is closed and even when it is opened to allow fuel injection. Thus the internal pressure of the nozzle body is always prevented from sharply rising.

According to the first through third embodiments of the invention, the coupling shaft 8*b* is fitted with the large-diameter shaft portion 80 vertically and integrally movable with the needle valve 4, and according to the fourth embodiment of the invention, the driving shaft body 8*a* is also provided with the large-diameter shaft portion 80, so that these portions function as an area seal. In other words, a drop in injection pressure and a shortage of injection quantity due to fuel leakage from the driving shaft system can be prevented.

As set forth above according to the invention, the plurality of injection holes are circumferentially arranged in the leading end portion of the nozzle body at the predetermined intervals and at axially different circumferential levels, and the injection holes at each circumferential level are set different in diameter. The rotary valve is circumferentially provided with the multistage independent fuel guide holes each communicating with the corresponding injection holes. Since the fuel guide holes and the injection holes at each circumferential level are put out of phase with one another in terms of communication, the freedom of setting the injection holes is extremely high and by controlling the angle of rotation of the rotary valve, fuel can be atomized with hole diameter variations of not less than two kinds. Therefore, the arrangement above has an excellent effect in that not only Nox at the time of light load but also smoke at the time of heavy load is readily reducible. Moreover, the fuel guide holes of the rotary valve and the injection holes of the nozzle body are arranged in such a relationship that irrespective of the rotary position of the rotary valve, the fuel guide holes at one or more than one circumferential level are each made to communicate with the fuel guide holes at one or more than one corresponding circumferential level and that the fuel guide holes at the other circumferential levels are not allowed to communicate with any injection holes, whereby the pressure within the nozzle body is prevented from rising more than necessary even though the injection holes are changed during the injection operation. Therefore, the injection hole system is set free from any danger of breakdown even when abnormality occurs or when follow-up control is delayed with the effect of increasing safety.

Also, according to the invention, the upward movement of the rotary valve triggered by the injection pressure is used to communicate the fuel guide holes with the injection holes only at the time of fuel injection, whereas the fuel guide holes are prohibited from communicating with the injection holes at the time of other than the fuel injection. Since the hole is prevented from communicating with the engine cylinder, this arrangement has the effect, in addition to what has been described above, of validly preventing after-dripping.

Further, according to the invention, a drop in injection pressure and a shortage of injection quantity due to fuel leakage from the driving shaft system of the rotary valve can effectively be prevented.

Still further, according to the innovative invention, the rotation of the rotary valve is controlled during the intake or exhaust stroke given by the engine without being affected by the pressure in the engine cylinder, whereby it is possible to set the injection hole area at small torque with the effect of making smaller the size of the actuator for driving the rotary valve.

Yet still further, according to the invention, the nozzle is easy to machine because the leading end of the hole has an opening.

While there has been described in connection with the preferred embodiment of this invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A variable injection hole type fuel injection nozzle, comprising:

a nozzle body having a leading end portion in which a fuel introduction hole for introducing pressurized fuel is defined; and a rotary valve disposed in the leading end portion of said nozzle body so as to be rotatable in the fuel introduction hole and having a plurality of fuel guide holes;

wherein said nozzle body has a plurality of injection holes circumferentially arranged in a peripheral wall of the fuel introduction hole at predetermined intervals and at axially different circumferential levels, and the injection holes at each circumferential level are set different in diameter, and the fuel guide holes correspond to the injection holes at the respective circumferential levels; and wherein the fuel guide holes of said rotary valve and the injection holes of said nozzle body are arranged in such a relationship that, irrespective of the rotary position of the rotary valve, the fuel guide holes at one or more than one circumferential level are each made to communicate with the injection holes at one or more than one corresponding circumferential level and that the fuel guide holes at the other circumferential levels are not allowed to communicate with any of said injection holes.

2. A variable injection hole type fuel injection nozzle as claimed in claim 1, wherein said fuel introduction hole is closed at the leading end portion of said further body; and wherein said nozzle further comprises a return spring disposed in an upper portion of said rotary valve, for pressing said rotary valve toward a bottom of the fuel introduction hole; and the fuel guide holes are each allowed to communicate with the corresponding injection holes only when said rotary valve is lifted on receiving pressurized fuel from the fuel introduction hole.

3. A variable injection hole type fuel injection nozzle as claimed in claim 1, further comprising a needle valve internally fitted to said nozzle body, and a rotary-valve driving unit with an area seal portion disposed within said needle valve, said area seal portion be vertically movable together with said needle valve.

4. A variable injection hole type fuel injection nozzle as claimed in claim 2, further comprising a needle valve internally fitted to said nozzle body, and a rotary-valve driving unit with an area seal portion disposed within said needle valve, said area seal portion being vertically movable together with said needle valve in said.

5. A variable injection hole type fuel injection nozzle as claimed in claim 1, further comprising an actuator for actuating said rotary valve in synchronization with an engine intake or exhaust stroke.

6. A variable injection hole type fuel injection nozzle as claimed in claim 1, wherein the fuel introduction hole extends through said nozzle body leading end portion and said rotary valve is fitted in said fuel introduction hole at said nozzle body leading end portion.

* * * * *

UNITED STATES PATENT AND TRADEMARK OFFICE

CERTIFICATE OF CORRECTION

PATENT NO. : 5,645,225

DATED : July 8, 1997

INVENTOR(S) : Hasegawa et al.

Figure 3A:
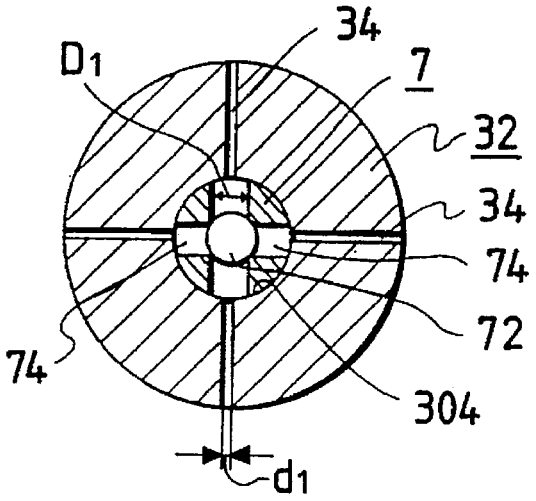
FIG. 3A is an enlarged transverse sectional view showing the variable injection hole type fuel injection nozzle taken on line I—I of FIG. 2.
Figure 3B:
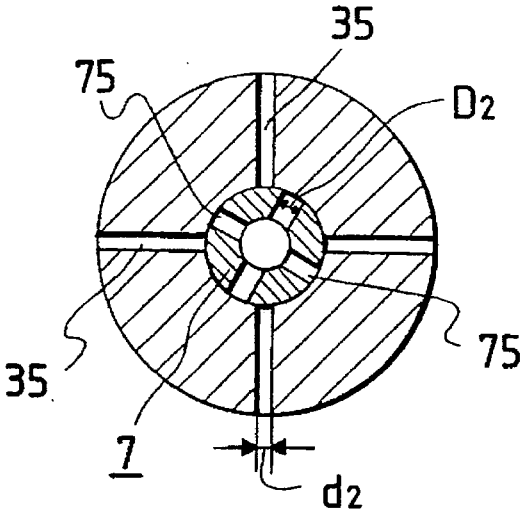
FIG. 3B an enlarged transverse sectional view showing the variable injection hole type fuel injection nozzle taken on line II—II of FIG. 2 showing the intermediate fuel guide hole displaced from the state shown in FIG. 3A by 30° clockwise.
Figure 3C:
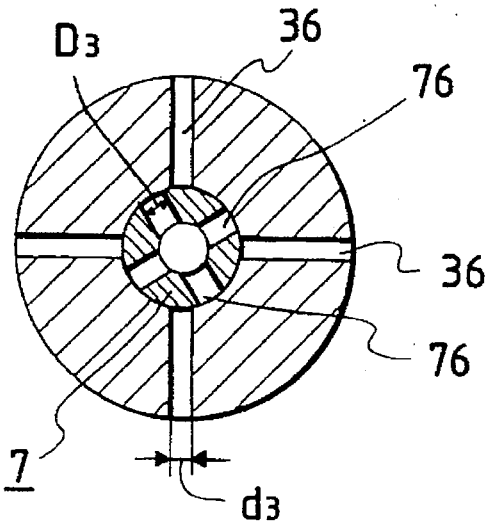
FIG. 3C is an enlarged transverse sectional view taken on line III—III of FIG. 2 showing the lower fuel guide hole displaced from the state shown in FIG. 3B by 30° clockwise.

It is certified that error appears in the above-indentified patent and that said Letters Patent is hereby corrected as shown below:

Column 4, line 48, after "FIG. 3B" insert --is--.

Column 6, line 41, delete "5".

Column 12, line 54, delete "c" and insert --c--.

Column 19, line 19 (Claim 2, line 3), delete "further" and insert --nozzle--.

Column 20, line 12 (Claim 4, line 6), delete "in said".

Signed and Sealed this

Eleventh Day of November, 1997

*Attest:*

Bruce Lehman

BRUCE LEHMAN

*Attesting Officer*

*Commissioner of Patents and Trademarks*